US005879280A

United States Patent [19]

Hlavinka et al.

[11] Patent Number: 5,879,280

[45] Date of Patent: Mar. 9, 1999

[54] INTERMITTENT COLLECTION OF MONONUCLEAR CELLS IN A CENTRIFUGE APPARATUS

[75] Inventors: Dennis Hlavinka, Arvada; Thomas J. Felt, Boulder, both of Colo.

[73] Assignee: COBE Laboratories, Inc., Lakewood, Colo.

[21] Appl. No.: 871,207

[22] Filed: Jun. 9, 1997

Related U.S. Application Data

[62] Division of Ser. No. 422,597, Apr. 14, 1995, Pat. No. 5,704,888.

[51] Int. Cl.[6] ..... B04B 11/04

[52] U.S. Cl. ..... 494/10; 494/45

[58] Field of Search ..... 494/1, 10, 11, 494/18, 21, 45; 210/781, 782; 604/4–6

[56] References Cited

U.S. PATENT DOCUMENTS

| | | |
|---|---|---|
| 1,723,212 | 8/1929 | Sheeran . |
| 3,452,924 | 7/1969 | Schultz . |
| 3,655,123 | 4/1972 | Judson et al. . |
| 3,708,110 | 1/1973 | Unger et al. . |
| 3,737,096 | 6/1973 | Jones et al. . |
| 3,858,795 | 1/1975 | Joyce . |
| 3,858,796 | 1/1975 | Unger et al. . |
| 4,007,871 | 2/1977 | Jones et al. . |
| 4,010,894 | 3/1977 | Kellogg et al. . |
| 4,091,989 | 5/1978 | Schultz . |
| 4,094,461 | 6/1978 | Kellogg et al. . |
| 4,120,448 | 10/1978 | Cullis . |
| 4,151,844 | 5/1979 | Cullis et al. . |
| 4,187,979 | 2/1980 | Cullis et al. . |
| 4,316,576 | 2/1982 | Cullis et al. . |
| 4,330,080 | 5/1982 | Mathieu . |
| 4,356,958 | 11/1982 | Kolobow et al. . |
| 4,386,730 | 6/1983 | Mulzet . |
| 4,387,848 | 6/1983 | Kellogg et al. . |
| 4,430,072 | 2/1984 | Kellogg et al. . |
| 4,447,221 | 5/1984 | Mulzet . |

(List continued on next page.)

FOREIGN PATENT DOCUMENTS

| | | |
|---|---|---|
| WO 93/12805 | 7/1993 | WIPO . |
| WO 94/08691 | 4/1994 | WIPO . |

OTHER PUBLICATIONS

Fresenius MT AS 104 blood cell separator, Apr. 6, 1990(OP), Operating Instructions, Chapter 2.

Gebrauchsanweisung, Kapitel 2, Fresenius MT Blutzellseparator AS 104, Jul. 3, 1992(GA); English translation Part 12.3.7.9, "Cycle Control and Spillover Parameters," Software version 4.6.

Operator's Manual, 7–19–3–185, Fenwal® CS–3000® Plus Blood Cell Separator, Oct. 1990.

Owner's Operating and Maintenance Manual, Haemonetics Mobile Collection System, Dec. 1, 1991, Rev.B., Part No. 35349, Haemonetics Corporation, Braintree, MA 02184.

A.L. Jones, "Blood Cell Washing," *IBM Technical Disclosure Bulletin,* vol. 10 No. 7, Dec. 1967, pp. 944–945.

*Primary Examiner*—Charles E. Cooley

*Attorney, Agent, or Firm*—Charles E. Rohrer

[57] ABSTRACT

A centrifuge apparatus is used for collecting white blood cells, primarily mononuclear cells, from whole blood stratified into layers. A thin mononuclear (MNC) layer is formed at the interface of red blood cells and plasma. A barrier is positioned in the separation vessel of the centrifuge at a location to intercept the thin layer. An MNC collect port is positioned in front of the barrier to collect the thin layer. MNC fluid is allowed to pool behind the barrier to surround the collect port before collection is started. Collection ceases when the pool is removed and allowed to build again. By operating the collect in an intermittent fashion, improvements in purity and collect volume are achieved. The intermittent collection procedure can be useful for harvesting granulocytes and, in general, any sparse stratified component of a centrifuged solution where the sparse component is layered between more dense and less dense strata.

20 Claims, 3 Drawing Sheets

U.S. PATENT DOCUMENTS

| | | | |
|---|---|---|---|
| 4,531,932 | 7/1985 | Luppi et al. | 494/18 X |
| 4,557,719 | 12/1985 | Neumann et al. . | |
| 4,636,193 | 1/1987 | Cullis | 494/45 |
| 4,647,279 | 3/1987 | Mulzet et al. . | |
| 4,668,214 | 5/1987 | Reeder . | |
| 4,708,712 | 11/1987 | Mulzet . | |
| 4,807,676 | 2/1989 | Cerny et al. . | |
| 4,838,852 | 6/1989 | Edelson et al. . | |
| 4,850,995 | 7/1989 | Tie et al. . | |
| 4,934,995 | 6/1990 | Cullis . | |
| 4,940,543 | 7/1990 | Brown et al. . | |
| 5,006,103 | 4/1991 | Bacehowski et al. . | |
| 5,104,526 | 4/1992 | Brown et al. . | |
| 5,141,486 | 8/1992 | Antwiler . | |
| 5,224,921 | 7/1993 | Dennehey et al. . | |
| 5,260,598 | 11/1993 | Brass et al. . | |
| 5,281,342 | 1/1994 | Biesel et al. . | |
| 5,322,620 | 6/1994 | Brown et al. . | |
| 5,437,598 | 8/1995 | Antwiler | 494/1 |
| 5,607,579 | 3/1997 | Latham, Jr. et al. | 494/1 X |

FIG. 3
(PRIOR ART)
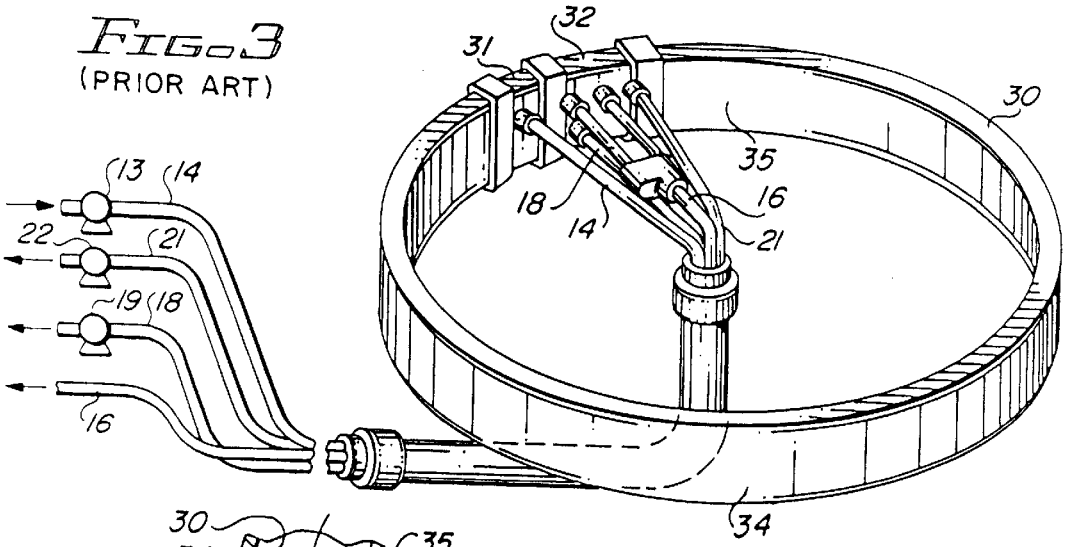
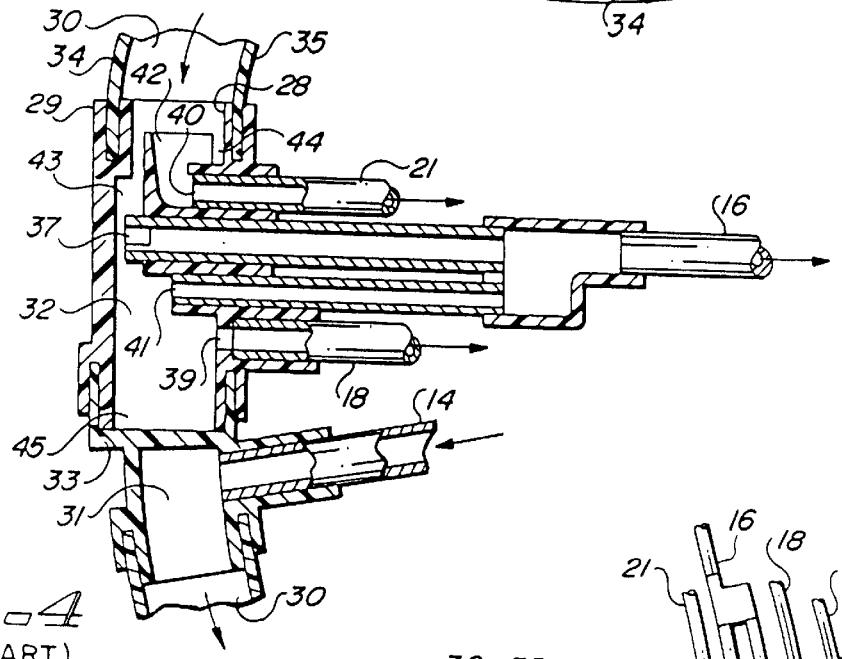
FIG. 4
(PRIOR ART)
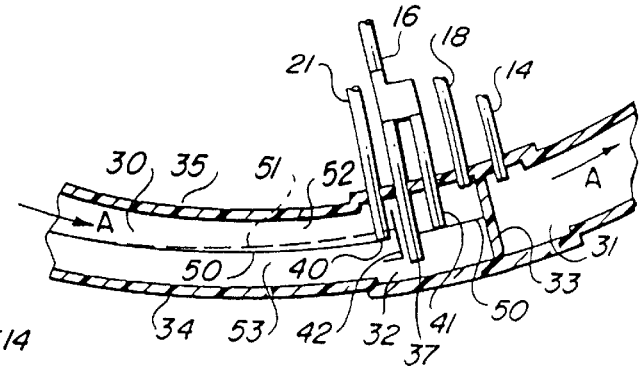
FIG. 5
(PRIOR ART)
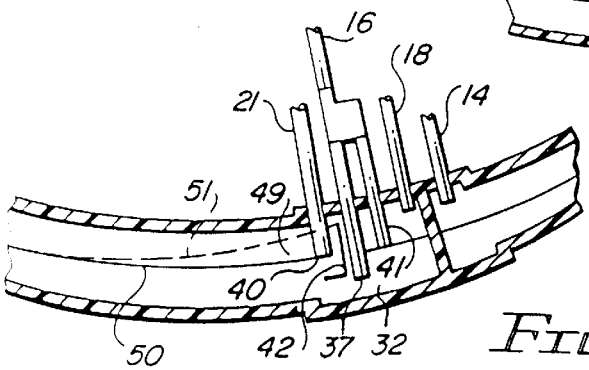
FIG. 6

INTERMITTENT COLLECTION OF MONONUCLEAR CELLS IN A CENTRIFUGE APPARATUS

This is a division of application Ser. No. 08/442,597 filed Apr. 14, 1995, now U.S. Pat. No. 5,704,888.

This invention relates to a system for the centrifugal processing of liquids such as whole blood and, more particularly, to improvements in the collection of species which are sparse within the liquid such as the mononuclear cell component of whole blood.

BACKGROUND OF THE INVENTION

Centrifugation is a technique used to process whole blood in order to separate the blood into its various components. To reduce personal contact with blood products and reduce cross-contamination between different blood sources, the centrifugal apparatus can be fitted with a disposable plastic vessel through which the blood is circulated. The vessel is fitted into a centrifuge fixture that is driven by a motor. An exemplary vessel is a circumferential separation channel having several outlets positioned at different radial positions within the channel in order to remove blood components which have been separated by the centrifuge into stratified layers of differing density. Red blood cells (RBC) being the most dense of the components are stratified within the channel at the most radially outward location whereas the stratified layer of plasma is the most radially inward layer. A relatively thin layer called the buffy coat contains white blood cells and platelets and is located at an interface position between the red blood cell layer and the plasma layer. Within the buffy coat the platelets are stratified toward the plasma while the white blood cells are stratified toward the red blood cells. Depending on centrifuge speed, platelets may also be dispersed within the plasma.

The disposable plastic vessel which is fitted into a rotating fixture within the centrifuge is connected to the blood source and to collection reservoirs through a disposable tubing set. In that manner, the centrifuge equipment itself is kept out of contact with blood and the disposable tubing set and separation channel are discarded after one procedure. The source of blood can be whole blood obtained directly from a donor or patient, or it can be previously donated bone marrow or blood.

Blood components may be collected from a patient, stored and perhaps frozen, and reinfused into the patient days or even years later. The mononuclear cell component of white blood cells is sometimes collected, stored in the above manner, and reinfused into the patient for the treatment of diseases such as cancer. There are obvious advantages to returning blood components from the patient's own blood rather than using the blood of a donor. It is generally agreed that the safest blood a person can receive is his or her own blood (autologous blood). The use of autologous blood reduces the risk of exposure to transfusion transmitted disease and febrile/allergic transfusion reactions. To accomplish the collection of white blood cells (WBC), an apheresis system has been developed for harvesting them from the buffy coat. In particular, the mononuclear cell (MNC) component of WBCs are harvested including lymphocytes, monocytes, progenitor cells, and stem cells. Efficient equipment for collecting MNCs is described in U.S. Pat. No. 4,647,279. However, even with efficient equipment, the collection of mononuclear cells is difficult since they make up only a small fraction of the total blood volume. For a patient of normal size with a normal MNC count, the total volume of MNCs may be about 1.5 milliliters, that is about 0.03% of the total blood volume. As a consequence, when whole blood is centrifuged, only a very thin MNC layer appears between the red blood cell and plasma layers.

The thin MNC layer presents a challenge when attempting an MNC harvest. Because the MNC fraction of whole blood is so small, the equipment referred to above includes a barrier positioned in the channel upstream of the RBC port. MNCs are accumulated at the barrier with a WBC collection port placed in front of the barrier. The fraction collected through the WBC collection port is actually a mixture of WBCS, platelets, plasma and RBCs. In collection procedures, the color of the collected fraction may be monitored with blood inflow and plasma outflow rates adjusted, manually or automatically, to fine tune the interface of the MNC layer with the RBC layer so that the MNC layer corresponds in position to the WBC collection port. Usually, an operator is used to make very fine adjustments of the speed of the plasma pump in order to position the interface properly for collection of the MNC layer, that is, the mononuclear white blood cell component. The operator judges the position of the interface according to the color of the fluid leaving the collection channel, and adjustments are made to provide the desired color in the collect port. Fine control is provided over the speed of the plasma pump such that adjustments may be made on the order of one tenth milliliter per minute. Even though small changes are possible in the speed of the pump, it is not unusual for a change in plasma pump speed to over or under-correct, necessitating further change in pump speed. As a consequence, the interface positioning system, manual or automatic, can be involved in a vibratory chasing of the correct interface position with the result of decreased efficiency and purity in collecting the MNC layer. A further problem is that after each change in pump speed the process requires a period of time for the change to take effect, that is, for the new interface position to become established. Attempts have been made to use optical monitoring equipment to judge the opacity of the collect volume and automatically adjust plasma pump speed. However, such techniques designed to automate the system are also subject to oscillations around the control point and generally provide little improvement over the system when it is operated manually. Basically, all of these problems result from the fact that the target species is sparse and forms a very thin stratified layer which is difficult to harvest separately from other components.

Because of the difficulty in properly positioning and maintaining the interface, a relatively wide band of volume is collected from the WBC port so that there is an assurance that the thin white blood cell layer has been collected. By collecting a wider band, however, a considerable amount of plasma, platelets, or red blood cells are also collected together with the white blood cells. Such a technique is efficient in the sense that it collects most of the stratified white cells, but it is low in purity. Also, the volume of collection is increased over what is needed. The goals of high MNC yield or efficiency and a low collection volume of high purity are somewhat mutually exclusive since it is difficult to extract only the thin stratified layer of white blood cells. Generally, volume and purity are sacrificed in favor of collection efficiency.

To further explain and illustrate, WBCs are comprised of mononuclear cells and polymorphonuclear cells (granulocytes). Granulocytes are normally a small sub-population of WBCs in healthy people but grow to a more significant sub-population when the body reacts to disease. When whole blood is centrifuged, depending on centrifuge speed, the thin buffy coat layer is itself stratified into a still thinner layer of MNCs and, a thin layer of platelets. The granulocytes are found in the buffy coat tending more toward the RBC layer and are also found in significant populations within the RBC layer. When the needs of a patient make it advisable to harvest granulocytes, a drug is generally provided to the patient which causes the granulocytes to migrate from the RBC layer into the buffy coat as a thin layer between the RBCs and the MNCs. In harvesting granulocytes, it has been necessary to also collect MNCs since the layers are too thin to be harvested separately. A substantial volume of RBCs and plasma are also collected in the procedure.

It is an object of the current invention to provide an improved collection procedure for harvesting thin layers of stratified components in centrifuged liquids such as mononuclear cells in blood in order to collect a decreased volume with higher purity at high efficiency.

SUMMARY OF THE INVENTION

Briefly stated, the invention relates to the intermittent collection of species which are sparse within a liquid, such as mononuclear cells (MNCs) which form a thin stratified layer at the interface of red blood cells and plasma when whole blood is centrifuged. A barrier is placed within the centrifuge separation channel at a location to intercept the thin layer. A collect port is positioned directly in front of the barrier at a level corresponding to the position of the thin mononuclear cell layer. As blood is pumped through the separation channel, fluid is collected through the collect port in an intermittent fashion, thereby allowing a pool of MNC fluid to form in front of the barrier and surround the collect port before MNC collection begins. Once begun, collection is continued only long enough to remove most of the MNC pool. Collection then ceases for a period long enough to rebuild the pool. Collection begins again, and the intermittent process continues until the volume of whole blood to be processed has been completed.

A process cycle volume is that amount of whole blood needed to build the desired MNC volume in front of the barrier. Process cycle volume is a function of the MNC count, the inlet flow rate, the separation factor, and the size of the barrier. Separation factor is a function of centrifuge speed, blood flow rate, and the geometry of the separation channel.

The intermittent collection procedure of the invention is also useful in collecting granulocytes, it can be used to harvest platelets and, in general, is useful for harvesting any stratified sparse species within a centrifuged liquid where the layer to be harvested forms between more dense and less dense strata.

BRIEF DESCRIPTION OF THE DRAWINGS

The above-mentioned and other features and objects of the invention and the manner of attaining them will become more apparent and the invention itself will best be understood by reference to the following description of embodiments of the invention taken in conjunction with the accompanying drawing, a brief description of which follows.

FIGS. 3 and 4 illustrate aspects of the circumferential separation channel for use with the inventive system.

FIGS. 5 and 6 are diagrammatic illustrations showing the position of the stratified blood components. FIG. 5 shows the stratification in prior art techniques, while FIG. 6 diagrammatically shows the formation of a WBC pool when utilizing the current invention.

DETAILED DESCRIPTION

Figure 1:
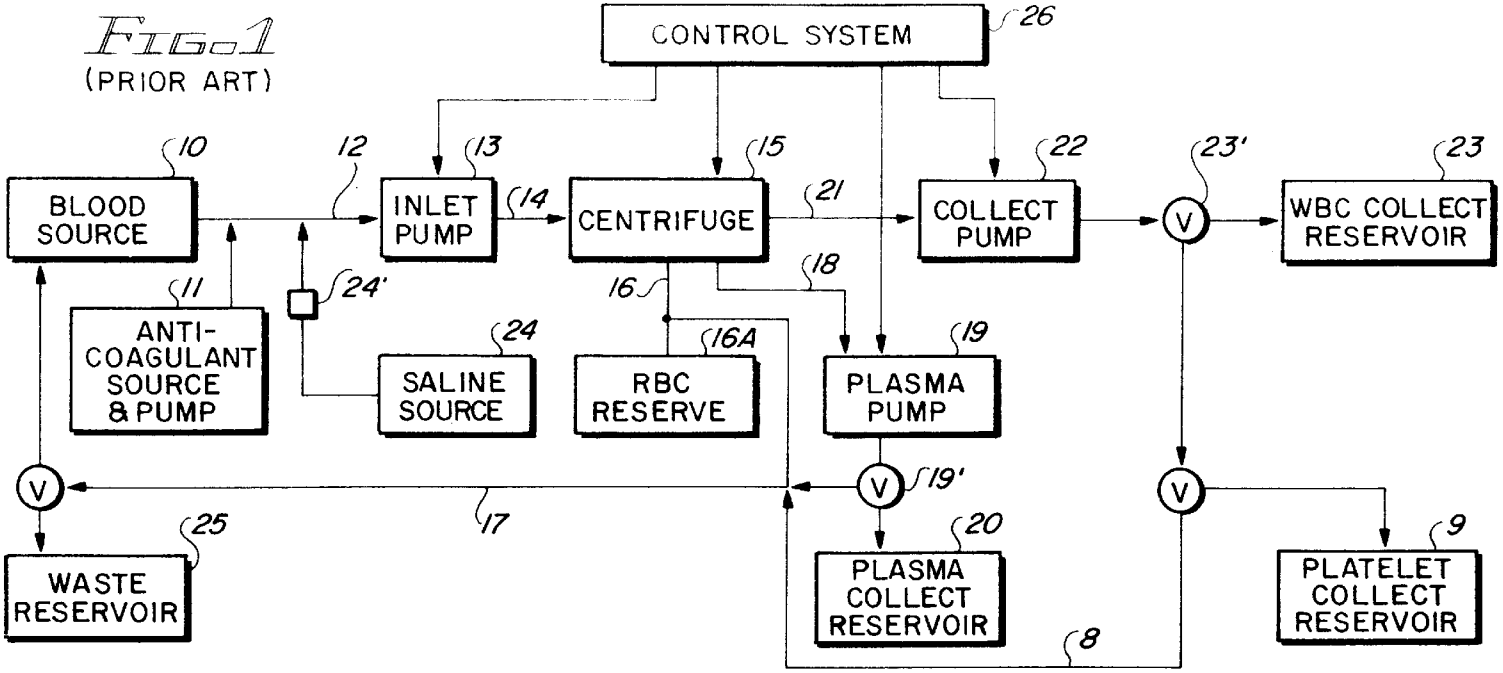
FIG. 1 (PRIOR ART)
FIG. 1 is a block diagram of an MNC collection system for utilizing the current invention.

Referring now to the drawings, like numbers indicate like features, and a reference number appearing in more than one figure refers to the same element.

FIG. 1 is a block diagram of a centrifuge system for collecting blood components. Such a system is the COBE® "SPECTRA"™ which is produced and sold by the assignee of the invention. Blood source 10 may be a donor or a patient from whom whole blood is removed through a needle, usually positioned in one of the donor's or patient's arms. Alternatively, a catheter may be positioned in one of the large veins. The blood source 10 may also be previously collected whole blood or bone marrow made available to the system of FIG. 1 from a reservoir. If blood or bone marrow has been previously collected, an anticoagulant (AC) solution will have already been added to the whole blood or marrow at the time it was collected and, consequently, additional anticoagulant solution may not be needed during the collection procedure. However, if blood is withdrawn directly from a donor or a patient, an AC source 11 is used to provide the required amount of anticoagulant solution to the whole blood. Entry of AC solution is preferably positioned in close proximity to the needle or catheter. In the following discussion, an MNC collection procedure is described using whole blood as the source of MNCs. The description is also accurate when bone marrow is used.

Figure 2:
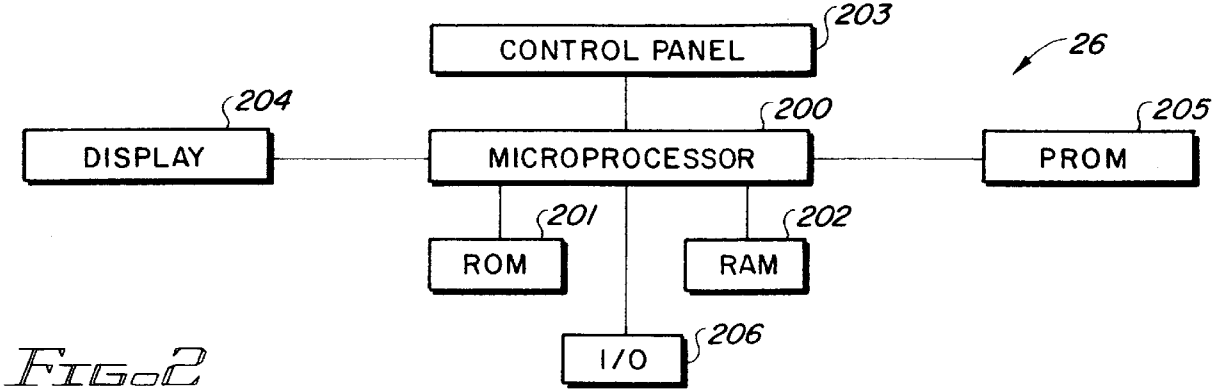
FIG. 2 (PRIOR ART)
FIG. 2 shows components of a control system for use with the collection system of FIG. 1.

Whole blood is drawn from the source 10 through inlet line 12 by an inlet pump 13 and passed through line 14 into centrifugal apparatus 15. Red blood cells, along with a reduced fraction of plasma, are collected and removed from the centrifuge through outlet line 16 and passed into return line 17 for return to the donor or patient. Plasma and platelets suspended therein, are removed through outlet line 18 through a plasma pump 19 and may also be returned to the donor or patient over return line 17. Alternatively, if a portion of the plasma is to be collected, it may be directed into a plasma collect reservoir 20 by toggling valve 19'. White blood cells are removed from the centrifuge over outlet line 21 by the WBC collect pump 22. The outlet of collect pump 22 is connected to a collect reservoir 23 through valve 23'. To prime the system, a saline solution in reservoir 24 may be used and is provided by opening clamp 24' and through inlet pump 13 to the channel and to the various lines within the tubing set of the system prior to beginning the collection procedure. Saline solution may also be used at the end of the procedure to clear blood from the lines. A waste reservoir 25 is included for receiving the saline solution. The control system 26 controls the various components within the system such as valves, pumps, centrifuge, etc. Any suitable type of control technology may be used, but it is advantageous to use a microprocessor-based system through which system parameters may be easily changed through the flexibility offered by control programs. FIG. 2 illustrates such a system.

FIG. 2 shows a microprocessor 200 connected to a read only memory (ROM) 201, a random access memory (RAM) 202, a control panel 203, a display device 204, and erasable programmable read only memory (PROM) 205. The control panel 203 may contain a keyboard or keypad for changing plasma pump speed or other system parameters. If desired, analog input control devices may be used on the panel together with analog to digital (ADC) converters. The display device 204 may be a monitor separate from the control panel, or it may be incorporated into the panel. The display device may be used to provide system information to an operator during operation of the system to enable manual adjustment of system parameters.

ROM 201 contains initializing programs so that the microprocessor can check the availability of all control components and otherwise ready the control system for performing whatever operations are required of it. RAM 202 is a writable memory into which is placed the control programs for operating the system according to the particular procedure to be performed. RAM 202 provides for a rapid interchange of data with the microprocessor 200. The PROM 205 contains control programs. For example, if an MNC collection is to be performed, a control program for that procedure is contained within PROM 205. The control procedure may be transferred to RAM 202 or it may directly interface with processor 200. Input and output lines 206 from microprocessor 200 lead to control components for the various valves, monitoring devices and pumps within the system. In systems such as the COBE "SPECTRA" several microprocessor systems such as shown in FIG. 2 may be used and the control functions split among the different systems. By utilizing several microprocessors, redundancy is obtained to make the equipment more fail-safe.

FIGS. 3 and 4 are views of the circumferential separation channel used in the COBE "SPECTRA" to separate whole blood into its components for the collection of white blood cells. Separation channel 30 is a disposable element which is placed within the centrifuge apparatus 15. Inlet pump 13 supplies whole blood through inlet line 14 to an inlet chamber 31. Outlet chamber 32 is adjacent to the inlet chamber 31 but separated therefrom by a solid partition 33. As a consequence, the whole blood input into chamber 31 must flow around the entire circumference of the separation channel 30 before it reaches the outlet chamber 32. During the time period in which blood flows through the separation channel 30, operation of the centrifuge results in separation of the whole blood into various layers with the dense red blood cells accumulating along the outer wall 34 while the plasma component accumulates in a layer more radially proximal to the inner wall 35.

FIG. 4, which shows a cross-sectional view of the inlet and outlet chambers, shows that the red blood cell collection line 16 is connected to a red blood cell port 37 which is positioned near the outer wall 29 of the outlet chamber 32 and therefore positioned in a manner to receive red blood cells. The plasma outlet line 18 is connected to plasma port 39 which is situated near the inner wall 28 of the outlet chamber 32. As a consequence, the lighter plasma is drawn through port 39 into the plasma outlet line 18.

The white blood cell collection line 21 is connected to a white blood cell or MNC port 40 which is approximately halfway between the inner wall 28 and the outer wall 29. A control port 41 is also located about halfway between the inner and outer walls and is used to control the position of the interface between the red blood cells and the plasma, that is the interface where the white blood cells build up. The control port is connected to the red blood cell return line 16.

Note that inlet pump 13 supplies whole blood to the separation chamber and pump 22 draws the white blood cells from the chamber through line 21 to a collect reservoir 23 (shown in FIG. 1). The plasma pump 19 is connected to the plasma outlet line 18 and removes plasma from the separation chamber for returning the plasma to the blood source, usually a patient, or should it be desired to collect some of the plasma, it might be diverted into a plasma collect reservoir 20 as shown in FIG. 1. Note that there is no pump on the red blood cell outlet line 16.

An important feature of the outlet collection chamber 32 is the dam or barrier 42 which is located in the mid-portion of the collection chamber and extends from one sidewall to the other. Red blood cells entering the collection chamber 32 can pass by the dam along the outer wall 29 through a passageway 43 as shown in FIG. 4. Plasma can pass along the inner wall 28 past the dam through passageway 44. As a consequence, both red blood cells and plasma flow into section 45 of the outlet collection chamber. White blood cells, however, due to their relative density float on top of the RBC layer, are trapped in front of the dam 42 and are thereby positioned at the WBC outlet port 40. In that fashion, white blood cells are properly positioned within the collection chamber to exit the chamber through outlet tube 21.

FIG. 5 is a diagrammatic illustration of the separation channel 30 showing the stratified layers of the blood and the various outlet ports associated with the collection chamber 32. As explained above, as blood moves around the separation chamber in the direction A, the influence of centrifugal force separates the blood into layers comprising various fractions, the heavier particles moving radially outwardly toward the outer wall 34. FIG. 5 shows the layer 53 comprised essentially of the more dense particles, the red blood cells. Plasma representing the lightest component of the blood is shown at 52 along the inner wall 35. An interface 50 is diagrammatically shown in FIG. 5 representing the interface between red blood cells and plasma. A thin layer, the buffy coat 51, forms at the interface and contains mononuclear cells and platelets. The collect port 40 is positioned at the interface in order to collect the buffy coat. To maintain the interface position correctly, an interface control port 41 is included in the separation chamber. By maintaining the interface in the correct position, the collect port 40 is properly located to collect the buffy coat.

Operation of the interface positioning port 41 is as follows: the speed of the plasma pump 19 is established in accordance with the speed of the inlet pump 13 and blood hematocrit, that is the volume of plasma withdrawn through port 41 is a function of the volume of the whole blood introduced and its hematocrit. By adjusting the speed of the plasma pump properly, enough plasma will be withdrawn from the collection chamber 32 to keep the interface at the correct position. During operation, should the interface 50 begin to move radially inwardly, a greater amount of the red cell component begins to flow through control port 41. Because the red cell component is more viscous than the plasma component, the increased red cell flow results in a reduced volume flowing through port 41. This reduced flow causes the plasma component to build up in the chamber 32, thereby pushing the interface radially outwardly back to the proper position. Similarly, if the interface 50 begins to move radially outwardly from port 41, the less viscous plasma component flows more quickly through port 41, reducing the plasma in collect chamber 32, causing the red blood cell layer to increase, thereby causing the interface 50 to return to the position of the control port 41. In that manner, the interface 50 is maintained at collect port 40 which is the correct position within the collection chamber 32 to achieve a collection of the buffy coat.

As mentioned above, the technique of continuously collecting white blood cells through a system such as described above produces relatively high efficiency, that is, most of the white blood cells are collected. However, the purity of the collection is sometimes less than desired and the volume of the collected quantity is greater than needed. This occurs because of the difficulty in positioning and maintaining the position of the thin buffy coat layer exactly at collect port 40. As a result, the system is usually controlled to collect a relatively wide band of volume from the collect port 40, thereby collecting most of the white blood cells. By collecting a wider band, however, a considerable amount of plasma, platelets and red blood cells are also collected together with the white blood cells. In the system described above, fine adjustments must be made to the speed of the plasma pump in order to position the interface properly for collection of the white blood cell component. These adjustments are made by visually inspecting the flow through the collect port. Should the flow become slightly more opaque, the operator may adjust the speed of the plasma pump to slightly increase the volume of plasma in the collect chamber. Problems associated with "chasing" the interface may result as mentioned above.

Problems associated with the correct positioning of the interface are eliminated through use of the current invention. FIG. 6 is a diagrammatic illustration of the collect chamber 32 showing the stratified components of the blood when the current invention is in operation. Note that the position of the interface 50 is maintained by control port 41 as previously described. A buffy coat 51 appears as a stratified layer at the interface due to the action of the centrifuge. In the invention, however, the white blood cell collect pump 22 is not started. As a result, an MNC layer builds up in front of the dam 42 to form a pool 49, thus providing a much thicker band of MNC component at collect port 40. In that fashion, when collect pump 22 is started, the thicker MNC layer provides a larger target which is less sensitive to drifting of the control mechanisms in the device. Once the thicker volume of MNCs is depleted, the collect pump 22 is stopped, once again allowing a buildup of MNC volume in front of dam 42. Periodically the MNC volume is harvested. Through use of the inventive technique the collected volume is smaller and the purity greater when compared to previous methods. Additionally, it is no longer necessary to monitor the presence of red blood cells in the collect line 21 nor is it necessary for the operator to make fine adjustments of the plasma pump speed in accordance with the presence of red blood cells in collect line 21.

Figure 7:
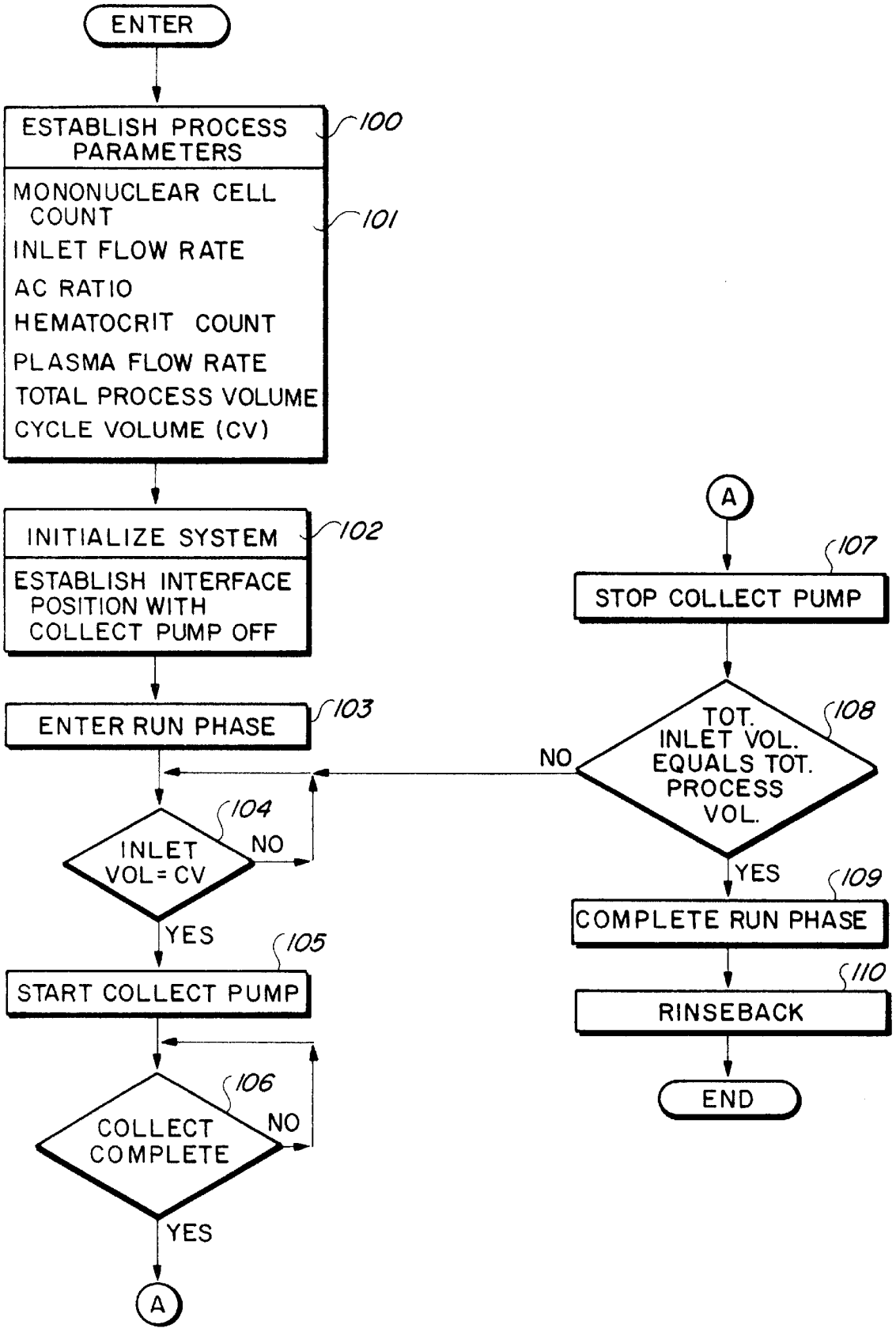
FIG. 7 is a flow chart of the control system of the invention for use with the collection system of FIG. 1.

The manner of achieving the desired results described above and producing the thick band of MNC volume shown in FIG. 6 is described in FIG. 7. When operating the system of FIG. 1, it is necessary to establish process parameters. Tests are taken of the whole blood to be processed in order to determine the hematocrit and the MNC count for that blood. The inlet flow rate is established in accordance with the type of access provided to the blood of the donor or patient and their tolerance for AC infusion access (if the blood is being directly withdrawn from a vein). The AC ratio is established according to clinical requirements. The total volume of whole blood to be processed together with the above parameters are input to the system through the control panel 203. The total process volume is a function of MNC concentration, inlet flow, separation factor and barrier geometry. The speed of the plasma pump is established by the control system as a function of the input flow rate and hematocrit. The separation factor is also established which sets the speed of the centrifuge. It may be constant in many implementations. Another process parameter is the collect flow rate which also may be constant in many implementations.

In an embodiment of the invention, a process cycle volume is calculated in accordance with the process parameters described above. The process cycle volume is defined as that volume of whole blood needed to establish the volume of white cells which fill the space in front of the barrier in the channel without incurring spillover. Note that if the flow rate is high and the red blood cells and plasma are flowing around the barrier at a high rate, there might be some reduction in the volume of the white cells which can be collected in a pool behind the barrier before incurring spillover. The process cycle volume is a function of the MNC count, the separation factor and the geometry of the barrier. The process cycle volume is specific to specific equipment.

In addition to establishing the process cycle volume, the time period for running the collect pump must also be established. Again, this relates to the size of the barrier and the volumetric rate of the collect pump.

With these factors known, with reference to FIG. 7 at steps 100 and 101, the system of FIG. 1 may be initialized as shown in step 102. Whole blood is introduced into the system and a period of time provided to remove any saline solution which might have been used to prime the system and to establish the interface position properly with the collect pump off. Once the system is initialized and stabilized, the run phase is entered at step 103. The previously calculated process cycle volume is introduced into the separation chamber as shown at step 104, thereby allowing a buildup of WBC volume behind the barrier. Once the process cycle volume has been reached, the collect pump is started as shown at step 105. The collect pump is run for the previously calculated period of time necessary to remove the pool of MNC from behind the barrier, at which time the collect pump is stopped at step 107. At step 108 the total inlet volume since entering the run phase is compared to the total process volume to be processed. If the two are not equal, return is made to step 104 to introduce another process cycle volume. The process continues to intermittently collect the WBC pool behind the barrier until the total inlet volume equals the total volume to be processed. At that point, a branch is made to step 109 for completing the run phase and entering the rinseback phase 110. At step 109 the collect pump may be operated for a short period of time to remove WBC volume from the collect line and move it into the collect reservoir. At step 110, a saline solution is used to rinse the entire channel and tubing set. This procedure flushes whole blood out of the system and to the patient so that there is very little loss of blood to the patient during the procedure.

It should be noted that once the interface position is established and the run phase of the inventive procedure entered, there should be no requirement for further adjustment of the speed of the plasma pump. In the previous techniques, the interface position was critical since the thickness of the white blood cell layer at the interface was so thin. In the intermittent flow procedure of the invention, the white blood cell volume is allowed to build up behind the barrier, thus providing a significant thickness to the white blood cell layer and making the exact interface position much less critical. As a consequence, there is no need to monitor the hematocrit content of the collect line either visually or through optical components.

As mentioned above, the MNC component of WBCs includes mature cells such as lymphocytes and also includes precursor cells such as progenitors and stem cells. Harvesting progenitors and/or stem cells as a separate species is the subject of International patent application WO93/12805, wherein methods are described for culturing such species in a liquid culture medium. The invention described herein may be of value in separating the progenitor cells and/or stem cells from the culture solution.

While the invention has been described above with respect to specific embodiments, it will be understood by those skilled in the art that various changes in form and details may be made therein without departing from the spirit and scope of the invention. For example, an RBC pump might be utilized rather than an inlet pump. Monitoring devices may be used to discern build up of the MNC pool rather than relying on previously calculated process cycle volume values. Similarly, the period of collection may be varied through use of monitoring devices. Control over the process is illustrated as provided by a programmed microprocessor. Such control could also be provided by any number of known control technologies. These and other variations are within the spirit and scope of the invention which receives definition in the following claims.

We claim:

1. A system for the centrifugal processing of a liquid for separating and collecting a sparse component of said liquid comprising:

an inlet line for receiving said liquid;

a centrifuge apparatus with a separation vessel connected to said inlet line for separating components into stratified layers within said vessel, said stratified layers including a layer of said sparse component, a layer of less dense component and a layer of more dense component;

a barrier located within said separation vessel to intercept the stratified layer of said sparse component formed at the interface of said layer of more dense component and said layer of less dense component;

a collect port located in front of said barrier and positioned at said interface to collect said stratified layer of said sparse component;

control apparatus for operating said system to allow a pool of said sparse component to form in front of said barrier during a pooling period;

said control apparatus for operating said system to remove at least a portion of said pool through said collect port during a collecting period; and said control apparatus for alternating control of said system between said pooling period and said collecting period.

2. The system of claim 1 further including a collect pump connected to said collect port by a collect line, said collect pump controllably connected to said control apparatus.

3. The system of claim 2 further including an inlet pump connected to said inlet line and wherein said separation vessel further includes:

an inlet chamber connected to receive said liquid from said inlet line;

an outlet chamber;

a circumferential channel connected to said inlet chamber on a first end and to said outlet chamber on a second end whereby said liquid is pumped through said separation vessel from said inlet chamber to said outlet chamber and wherein said liquid is stratified through the operation of said centrifuge apparatus.

4. The system of claim 3 wherein said outlet chamber further includes said barrier, said collect port and at least one other port for removing liquid not removed through said collect port.

5. The system of claim 4 wherein said outlet chamber further includes an interface positioning port located behind said barrier.

6. The system of claim 5 wherein said control apparatus is enabled to establish a process cycle volume as a function of the count of said sparse component within said liquid, the separation factor of said system and the size of said barrier, said process cycle volume being that volume of said liquid needed to establish said pool of sparse component which fills the space in front of said barrier without spilling past said barrier, said separation factor is a function of the centrifuge speed, inlet flow rate, and the geometry of the separation vessel.

7. The system of claim 6 wherein said control apparatus is enabled to establish a first period of time to allow said pool of sparse component to form in front of said barrier, said first period of time being a function of said process cycle volume and the volumetric rate of said inlet pump to define said pooling period.

8. The system of claim 7 wherein said control apparatus is enabled to establish a second time period as a function of the volume of said pool of sparse component and the volumetric rate of said collect pump to define said collecting period.

9. The system of claim 8 wherein said liquid is whole blood, wherein said sparse component is essentially mononuclear cells and wherein said more dense component is essentially red blood cells and said less dense component is essentially plasma.

10. The system of claim 8 wherein said liquid is whole blood, wherein said sparse component is essentially granulocytes and wherein said more dense component is essentially red blood cells and said less dense component is essentially mononuclear cells and/or plasma.

11. The system of claim 8 wherein said sparse component is essentially progenitor cells and/or stem cells.

12. The system of claim 1 wherein said liquid is whole blood, wherein said sparse component is essentially mononuclear cells and wherein said more dense component is essentially red blood cells and said less dense component is essentially plasma.

13. The system of claim 1 wherein said liquid is whole blood, wherein said sparse component is essentially granulocytes and wherein said more dense component is essentially red blood cells and said less dense component is essentially mononuclear cells and/or plasma.

14. The system of claim 1 wherein said sparse component is essentially progenitor cells and/or stem cells.

15. The system of claim 1 wherein said control apparatus is enabled to establish a process cycle volume as a function of the count of said sparse component within said liquid, the separation factor of said system and the size of said barrier, said process cycle volume being that volume of said liquid needed to establish said pool of sparse component which fills the space in front of said barrier without spilling past said barrier, said separation factor is a function of the centrifuge speed, inlet flow rate, and the geometry of the separation vessel.

16. The system of claim 15 further including an inlet pump connected to said inlet line and wherein said control apparatus is enabled to establish a first period of time to allow said pool of sparse component to form in front of said barrier, said first period of time being a function of said process cycle volume and the volumetric rate of said inlet pump to define said pooling period.

17. The system of claim 16 further including a collect pump connected to said collect port through a collect line and wherein said control apparatus is enabled to establish a second time period as a function of the volume of said pool of sparse component and the volumetric rate of said collect pump to define said collecting period.

18. The system of claim 17 wherein said liquid is whole blood, wherein said sparse component is essentially mononuclear cells and wherein said more dense component is essentially red blood cells and said less dense component is essentially plasma.

19. The system of claim 17 wherein said liquid is whole blood, wherein said sparse component is essentially granulocytes and wherein said more dense component is essentially red blood cells and said less dense component is essentially mononuclear cells and/or plasma.

20. The system of claim 17 wherein said sparse component is essentially progenitor cells and/or stem cells.

* * * * *